US007609218B2

(12) United States Patent
Frye et al.

(10) Patent No.: US 7,609,218 B2
(45) Date of Patent: Oct. 27, 2009

(54) ENHANCED BACK ASSEMBLY FOR KA/KU ODU

(75) Inventors: Mike A. Frye, San Pedro, CA (US); Gustave Stroes, Beverly Hills, CA (US)

(73) Assignee: The DIRECTV Group, Inc., El Segundo, CA (US)

( * ) Notice: Subject to any disclaimer, the term of this patent is extended or adjusted under 35 U.S.C. 154(b) by 0 days.

(21) Appl. No.: 11/546,186

(22) Filed: Oct. 11, 2006

(65) Prior Publication Data

US 2007/0195006 A1 Aug. 23, 2007

Related U.S. Application Data

(60) Provisional application No. 60/725,781, filed on Oct. 12, 2005, provisional application No. 60/725,782, filed on Oct. 12, 2005, provisional application No. 60/726,118, filed on Oct. 12, 2005, provisional application No. 60/726,149, filed on Oct. 12, 2005, provisional application No. 60/726,150, filed on Oct. 12, 2005, provisional application No. 60/726,151, filed on Oct. 12, 2005, provisional application No. 60/727,143, filed on Oct. 14, 2005, provisional application No. 60/726,338, filed on Oct. 12, 2005, provisional application No. 60/754,737, filed on Dec. 28, 2005, provisional application No. 60/758,762, filed on Jan. 13, 2006, provisional application No. 60/726,337, filed on Oct. 12, 2005.

(51) Int. Cl.
*H01Q 3/00* (2006.01)

(52) U.S. Cl. ..... 343/765

(58) Field of Classification Search ..... 343/760, 343/878, 894, 765–766

See application file for complete search history.

(56) References Cited

U.S. PATENT DOCUMENTS

| | | | |
|---|---|---|---|
| 4,656,486 | A | 4/1987 | Turner |
| 4,860,021 | A | 8/1989 | Kurosawa et al. |
| 5,617,107 | A | 4/1997 | Fleming |
| 5,734,356 | A | 3/1998 | Chang |
| 5,787,335 | A | 7/1998 | Novak |
| 5,898,680 | A | 4/1999 | Johnstone et al. |
| 5,959,592 | A | 9/1999 | Petruzzelli |
| 5,982,333 | A | 11/1999 | Stillinger et al. |
| 6,011,597 | A | 1/2000 | Kubo |
| 6,188,372 | B1 | 2/2001 | Jackson et al. |
| 6,340,956 | B1 | 1/2002 | Bowen et al. |
| 6,424,817 | B1 | 7/2002 | Hadden |
| 6,441,797 | B1 | 8/2002 | Shah |
| 6,486,907 | B1 | 11/2002 | Farber |
| 6,600,730 | B1 | 7/2003 | Davis et al. |
| 6,622,307 | B1 | 9/2003 | Ho |
| 6,653,981 | B2 | 11/2003 | Wang et al. |

(Continued)

FOREIGN PATENT DOCUMENTS

WO WO 2004/054128 6/2004

*Primary Examiner*—Huedung Mancuso

(57) ABSTRACT

An alignment mechanism for aligning an antenna to a satellite configuration is disclosed. An apparatus in accordance with the present invention comprises an antenna for receiving the satellite signals, a mast, for mounting the antenna to a desired location, and an alignment mechanism, coupled between the antenna and the mast, comprising an azimuth mechanism having a predetermined pre-load for adjusting the azimuth position of the antenna, and an elevation mechanism, coupled to the azimuth mechanism, for adjusting the elevation of the antenna, wherein the azimuth mechanism has a radius larger than a radius of the mast, and the azimuth mechanism further comprises a fine adjustment mechanism.

16 Claims, 5 Drawing Sheets

U.S. PATENT DOCUMENTS

| | | | | |
|---|---|---|---|---|
| 6,710,749 | B2 * | 3/2004 | King | 343/757 |
| 6,728,513 | B1 | 4/2004 | Nishina | |
| 6,762,727 | B2 | 7/2004 | Rochford et al. | |
| 6,864,855 | B1 | 3/2005 | Fujita | |
| 6,879,301 | B2 | 4/2005 | Kozlovski | |
| 6,906,673 | B1 | 6/2005 | Matz et al. | |
| 6,965,343 | B1 | 11/2005 | Dybdal et al. | |
| 7,095,378 | B1 * | 8/2006 | Paquette | 343/757 |
| 7,162,200 | B2 * | 1/2007 | Tsay et al. | 455/3.02 |
| 7,239,285 | B2 | 7/2007 | Cook | |
| 2002/0003495 | A1 | 1/2002 | Johnstone et al. | |
| 2002/0084941 | A1 * | 7/2002 | Matz et al. | 343/760 |
| 2003/0023978 | A1 | 1/2003 | Bajgrowicz | |
| 2003/0122723 | A1 | 7/2003 | Luly et al. | |
| 2003/0129960 | A1 | 7/2003 | Kato | |
| 2004/0060065 | A1 | 3/2004 | James et al. | |
| 2004/0160375 | A1 * | 8/2004 | King | 343/757 |
| 2004/0169114 | A1 * | 9/2004 | Dierkes | 248/165 |
| 2004/0192190 | A1 | 9/2004 | Motoyama | |
| 2005/0052335 | A1 | 3/2005 | Chen | |
| 2005/0057428 | A1 | 3/2005 | Fujita | |
| 2005/0184923 | A1 | 8/2005 | Saito et al. | |
| 2006/0077097 | A1 | 4/2006 | Dybdal et al. | |

* cited by examiner

ENHANCED BACK ASSEMBLY FOR KA/KU ODU

CROSS-REFERENCE TO RELATED APPLICATIONS

This application claims the benefit under 35 U.S.C. § 119 (e) of the following and commonly-assigned U.S. provisional patent applications:

Application Ser. No. 60/725,781, filed on Oct. 12, 2005 by John L. Norin and Kesse Ho, entitled "TRIPLE STACK COMBINING APPROACH TO Ka/Ku SIGNAL DISTRIBUTION";

Application Ser. No. 60/725,782, filed on Oct. 12, 2005 by Kesse Ho and John L. Norin, entitled "SINGLE LOCAL OSCILLATOR SHARING IN MULTI-BAND KA-BAND LNBS";

Application Ser. No. 60/726,118, filed on Oct. 12, 2005 by John L. Norin, entitled "KA/KU ANTENNA ALIGNMENT";

Application Ser. No. 60/726,149, filed on Oct. 12, 2005 by Kesse Ho, entitled "DYNAMIC CURRENT SHARING IN KA/KU LNB DESIGN";

Application Ser. No. 60/726,150, filed on Oct. 12, 2005 by Kesse Ho, entitled "KA LNB UMBRELLA SHADE";

Application Ser. No. 60/726,151, filed on Oct. 12, 2005 by John L. Norin and Kesse Ho, entitled "BAND UPCONVERTER APPROACH TO KA/KU SIGNAL DISTRIBUTION";

Application Ser. No. 60/727,143, filed on Oct. 14, 2005 by John L. Norin and Kesse Ho, entitled "BAND UPCONVERTER APPROACH TO KA/KU SIGNAL DISTRIBUTION";

Application Ser. No. 60/726,338, filed on Oct. 12, 2005 by John L. Norin, Kesse Ho, Mike A. Frye, and Gustave Stroes, entitled "NOVEL ALIGNMENT METHOD FOR MULTI-SATELLITE CONSUMER RECEIVE ANTENNAS";

Application Ser. No. 60/754,737, filed on Dec. 28, 2005 by John L. Norin, entitled "KA/KU ANTENNA ALIGNMENT";

Application Ser. No. 60/758,762, filed on Jan. 13, 2006 by Kesse Ho, entitled "KA LNB UMBRELLA SHADE"; and Application Ser. No. 60/726,337, filed Oct. 12, 2005, entitled "ENHANCED BACK ASSEMBLY FOR KA/KU ODU," by Michael A. Frye et al., all of which applications are incorporated by reference herein.

BACKGROUND OF THE INVENTION

1. Field of the Invention

The present invention relates generally to a satellite receiver system, and in particular, to an antenna assembly for such a satellite receiver system.

2. Description of the Related Art

Satellite broadcasting of communications signals has become commonplace. Satellite distribution of commercial signals for use in television programming currently utilizes multiple feedhorns on a single Outdoor Unit (ODU) which supply signals to up to eight IRDs on separate cables from a multiswitch.

FIG. 1 illustrates a typical satellite television installation of the related art.

System 100 uses signals sent from Satellite A (SatA) 102, Satellite B (SatB) 104, and Satellite C (SatC) 106 (with transponders 28, 30, and 32 converted to transponders 8, 10, and 12, respectively), that are directly broadcast to an Outdoor Unit (ODU) 108 that is typically attached to the outside of a house 110. ODU 108 receives these signals and sends the received signals to IRD 112, which decodes the signals and separates the signals into viewer channels, which are then passed to television 114 for viewing by a user. There can be more than one satellite transmitting from each orbital location.

Satellite uplink signals 116 are transmitted by one or more uplink facilities 118 to the satellites 102-106 that are typically in geosynchronous orbit. Satellites 102-106 amplify and rebroadcast the uplink signals 116, through transponders located on the satellite, as downlink signals 120. Depending on the satellite 102-106 antenna pattern, the downlink signals 120 are directed towards geographic areas for reception by the ODU 108.

Each satellite 102-106 broadcasts downlink signals 120 in typically thirty-two (32) different sets of frequencies, often referred to as transponders, which are licensed to various users for broadcasting of programming, which can be audio, video, or data signals, or any combination. These signals have typically been located in the Ku-band Fixed Satellite Service (FSS) and Broadcast Satellite Service (BSS) bands of frequencies in the 10-13 GHz range. Future satellites will likely also broadcast in a portion of the Ka-band with frequencies of 18-21 GHz FIG. 2 illustrates a typical ODU of the related art.

ODU 108 typically uses reflector dish 122 and feedhorn assembly 124 to receive and direct downlink signals 120 onto feedhorn assembly 124. Reflector dish 122 and feedhorn assembly 124 are typically mounted on bracket 126 and attached to a structure for stable mounting. Feedhorn assembly 124 typically comprises one or more Low Noise Block converters 128, which are connected via wires or coaxial cables to a multiswitch, which can be located within feedhorn assembly 124, elsewhere on the ODU 108, or within house 110. LNBs typically downconvert the FSS and/or BSS-band, Ku-band, and Ka-band downlink signals 120 into frequencies that are easily transmitted by wire or cable, which are typically in the L-band of frequencies, which typically ranges from 950 MHz to 2150 MHz. This downconversion makes it possible to distribute the signals within a home using standard coaxial cables.

The multiswitch enables system 100 to selectively switch the signals from SatA 102, SatB 104, and SatC 106, and deliver these signals via cables 124 to each of the IRDs 112A-D located within house 110. Typically, the multiswitch is a five-input, four-output (5×4) multiswitch, where two inputs to the multiswitch are from SatA 102, one input to the multiswitch is from SatB 104, and one input to the multiswitch is a combined input from SatB 104 and SatC 106. There can be other inputs for other purposes, e.g., off-air or other antenna inputs, without departing from the scope of the present invention. The multiswitch can be other sizes, such as a 6×8 multiswitch, if desired. SatB 104 typically delivers local programming to specified geographic areas, but can also deliver other programming as desired.

To maximize the available bandwidth in the Ku-band of downlink signals 120, each broadcast frequency is further divided into polarizations. Each LNB 128 can receive both orthogonal polarizations at the same time with parallel sets of electronics, so with the use of either an integrated or external multiswitch, downlink signals 120 can be selectively filtered out from travelling through the system 100 to each IRD 112A-D.

IRDs 112A-D currently use a one-way communications system to control the multiswitch. Each IRD 112A-D has a dedicated cable 124 connected directly to the multiswitch, and each IRD independently places a voltage and signal combination on the dedicated cable to program the multiswitch. For example, IRD 112A may wish to view a signal that is provided by SatA 102. To receive that signal, IRD 112A sends a voltage/tone signal on the dedicated cable back to the multiswitch, and the multiswitch delivers the satA 102 signal to IRD 112A on dedicated cable 124. IRD 112B independently controls the output port that IRD 112B is coupled to, and thus may deliver a different voltage/tone signal to the multiswitch. The voltage/tone signal typically comprises a 13 Volts DC (VDC) or 18 VDC signal, with or without a 22 kHz tone superimposed on the DC signal. 13 VDC without the 22 kHz tone would select one port, 13 VDC with the 22 kHz tone would select another port of the multiswitch, etc. There can also be a modulated tone, typically a 22 kHz tone, where the modulation schema can select one of any number of inputs based on the modulation scheme. For simplicity and cost savings, this control system has been used with the constraint of 4 cables coming for a single feedhorn assembly 124, which therefore only requires the 4 possible state combinations of tone/no-tone and hi/low voltage.

To reduce the cost of the ODU 108, outputs of the LNBs 128 present in the ODU 108 can be combined, or "stacked," depending on the ODU 108 design. The stacking of the LNB 128 outputs occurs after the LNB has received and downconverted the input signal. This allows for multiple polarizations, one from each satellite 102-106, to pass through each LNB 128. So one LNB 128 can, for example, receive the Left Hand Circular Polarization (LHCP) signals from SatC 102 and SatB 104, while another LNB receives the Right Hand Circular Polarization (RHCP) signals from SatB 104, which allows for fewer wires or cables between the feedhorn assembly 124 and the multiswitch.

The Ka-band of downlink signals 120 will be further divided into two bands, an upper band of frequencies called the "A" band and a lower band of frequencies called the "B" band. Once satellites are deployed within system 100 to broadcast these frequencies, the various LNBs 128 in the feedhorn assembly 124 can deliver the signals from the Ku-band, the A band Ka-band, and the B band Ka-band signals for a given polarization to the multiswitch. However, current IRD 112 and system 100 designs cannot tune across this entire resulting frequency band without the use of more than 4 cables, which limits the usefulness of this frequency combining feature.

By stacking the LNB 128 inputs as described above, each LNB 128 typically delivers 48 transponders of information to the multiswitch, but some LNBs 128 can deliver more or less in blocks of various size. The multiswitch allows each output of the multiswitch to receive every LNB 128 signal (which is an input to the multiswitch) without filtering or modifying that information, which allows for each IRD 112 to receive more data. However, as mentioned above, current IRDs 112 cannot use the information in some of the proposed frequencies used for downlink signals 120, thus rendering useless the information transmitted in those downlink signals 120.

As system 100 includes new satellites, ODU 108 must be pointed in a more accurate fashion to properly receive downlink signals 120 for processing by IRD 112. However, current alignment techniques and ODU designs are not accurate enough for such alignments.

It can be seen, then, that there is a need in the art for an alignment schema and mechanical alignment mechanisms that can align an ODU for expanded systems 100.

SUMMARY OF THE INVENTION

To minimize the limitations in the prior art, and to minimize other limitations that will become apparent upon reading and understanding the present specification, the present invention discloses an alignment mechanism for aligning an antenna to a satellite configuration and a system for delivering satellite signals using the alignment mechanism. An apparatus in accordance with the present invention comprises an antenna for receiving the satellite signals, a mast, for mounting the antenna to a desired location, and an alignment mechanism, coupled between the antenna and the mast, comprising an azimuth mechanism having a predetermined preload for adjusting the azimuth position of the antenna, and an elevation mechanism, coupled to the azimuth mechanism, for adjusting the elevation of the antenna, wherein the azimuth mechanism has a radius larger than a radius of the mast, and the azimuth mechanism further comprises a fine adjustment mechanism.

Such an alignment mechanism can also optionally include the fine adjustment mechanism comprising a nut having plastic threads, the predetermined pre-load being provided by a rivet at a pivot point of the azimuth mechanism a pointer, coupled to the alignment mechanism, wherein the pointer indicating an azimuth position of the antenna, the pointer having a sharp point for indicating position, the elevation mechanism further comprises a second fine adjustment mechanism, and the second fine adjustment mechanism comprising a nut having plastic threads.

Other features and advantages are inherent in the system and method claimed and disclosed or will become apparent to those skilled in the art from the following detailed description and its accompanying drawings.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which show, by way of illustration, several embodiments of the present invention. It is understood that other embodiments may be utilized and structural changes may be made without departing from the scope of the present invention.

Overview

Currently, there are three orbital slots, each comprising one or more satellites, delivering direct-broadcast television programming signals to the various ODUs 108. However, ground systems that currently receive these signals cannot accommodate additional satellite signals without adding more cables, and cannot process the additional signals that will be used to transmit the growing complement of high-definition television (HDTV) signals. The HDTV signals can be broadcast from the existing satellite constellation, or broadcast from the additional satellite(s) that will be placed in geosynchronous orbit. The orbital locations of the Ku-BSS satellites are fixed by regulation as being separated by nine degrees, so, for example, there is a satellite at 101 degrees West Longitude (WL), SatA 102; another satellite at 110 degrees WL, SatC 106; and another satellite at 119 degrees WL, SatB 104. Additional satellites may be at other orbital slots, e.g., 72.5 degrees, 95, degrees, 99 degrees, and 103 degrees, and other orbital slots, without departing from the scope of the present invention. The satellites are typically referred to by their orbital location, e.g., SatA 102, the satellite at 101 WL, is typically referred to as "101." Additional orbital slots, with one or more satellites per slot, are presently contemplated at 99 and 103 (99.2 degrees West Longitude and 102.8 degrees West Longitude, respectively).

The present invention provides for a more accurate method and apparatus for aligning the ODU 108 with the satellites 102-106. An increased radius on the adjustment mechanisms allows for better reading of the scale and more precise alignment. Further, pivoting devices with a defined pre-load tension provides more consistent settings, as well as minimizing lockdown error once the proper position is found. Further, use of different materials for fine-adjustment screws reduces backlash that occurs when changing direction on the adjustment mechanism. Finally, a pointed locator pin ensures that the fine adjustment mechanisms are better centered on specified locations.

Pivot Mechanism and Degree Readings

Figure 1:
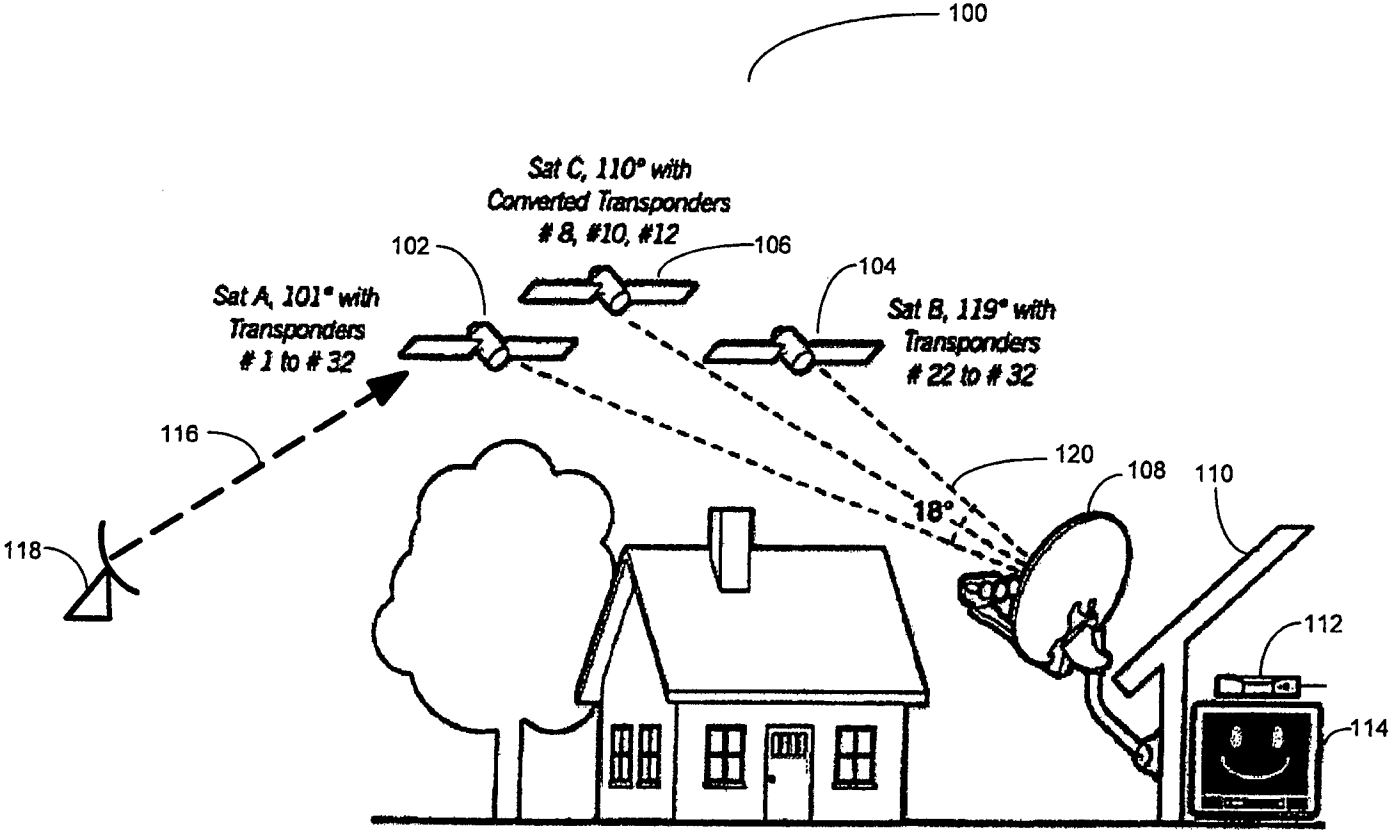
FIG. 1 PRIOR ART
FIG. 1 illustrates a typical satellite television installation of the related art.
Figure 2:
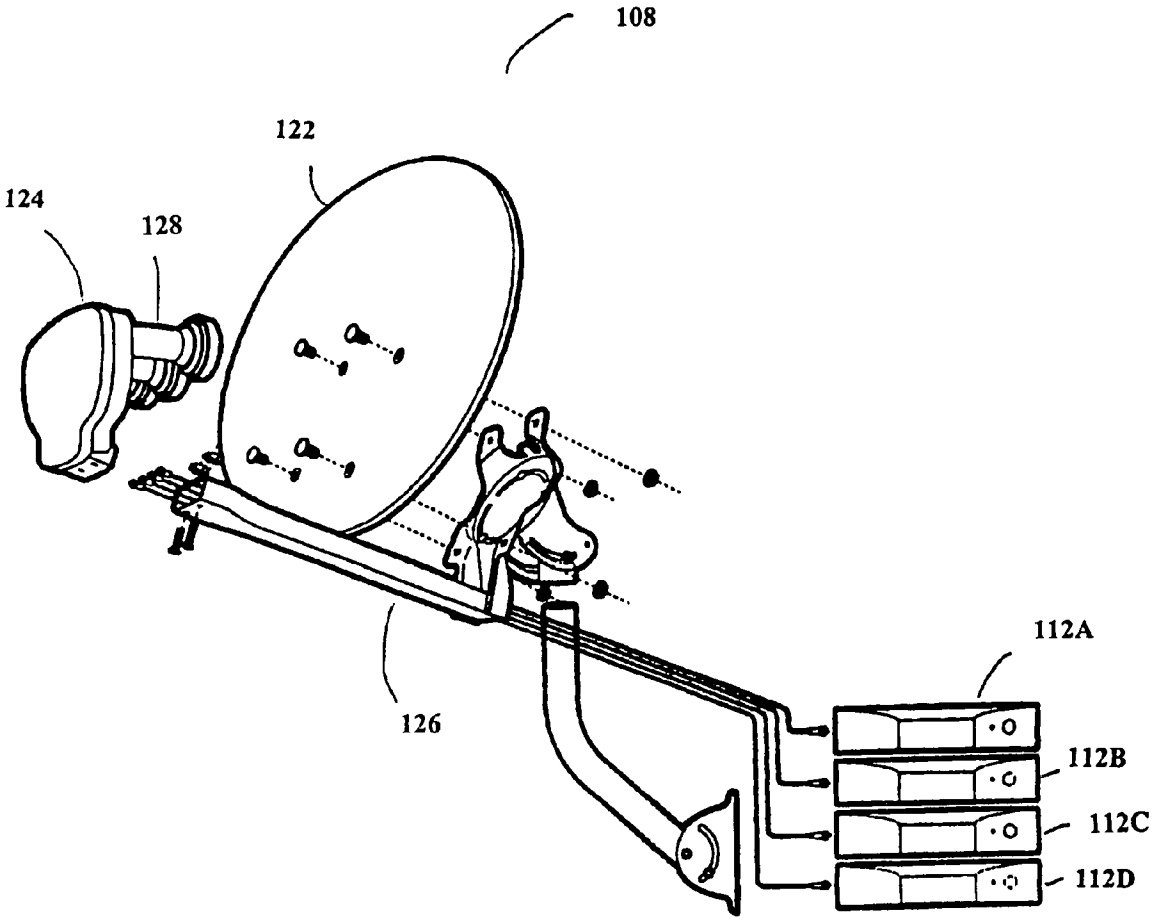
FIG. 2 illustrates a typical ODU of the related art.
Figure 3:
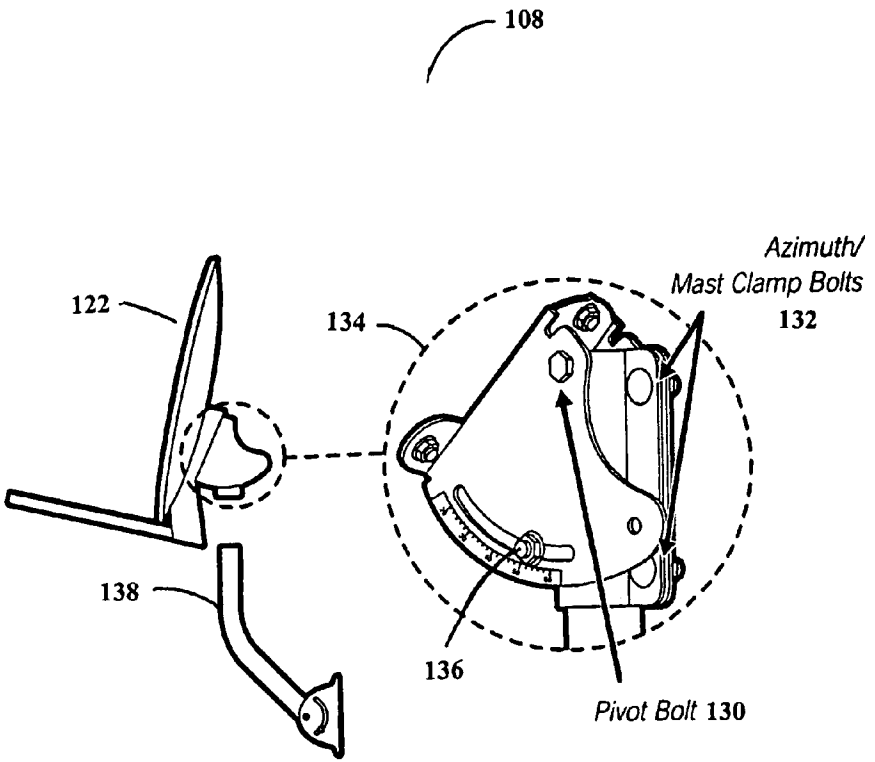
FIG. 3 illustrates an azimuth and elevation alignment mechanism of the related art.

FIG. 3 illustrates an azimuth and elevation alignment mechanism of the related art.

ODU 108 is shown, with reflector 122, and pivot bolt 130 and azimuth/mast clam bolts 132 which are part of alignment mechanism 134. Lock nut 136 and mast 138 are also shown. Mechanism 134 attaches to mast 138, and is secured using bolts 132.

To adjust the elevation of ODU 108, lock nut 136 is loosened, and a specific elevation angle is set for a specific geoposition of the ODU 108. The lock nuts are then tightened to hold the ODU 108 in the desired elevation angle.

To adjust the azimuth, ODU 108 is rotated about mast 138, and a signal meter is used to find a power peak for a given downlink signal 120. Bolts 132 are set at a specific pre-load, however, the bolts are typically loosened by installers so that mechanism 134 can fit easily on mast 138, which allows assembly 134 to rotate rather freely on mast 138. When bolts 132 are tightened, the setting for the azimuth of ODU 108 is typically lost, or moved through some slight degree, which puts errors into the alignment of ODU 108.

Further, there are no measurement scales on the azimuth setting for the ODU 108 of the related art. Without a more accurate mechanism, the pointing errors for ODU 108 will reduce the effectiveness of ODU 108 in terms of reception of downlink signals 120.

Figure 4:
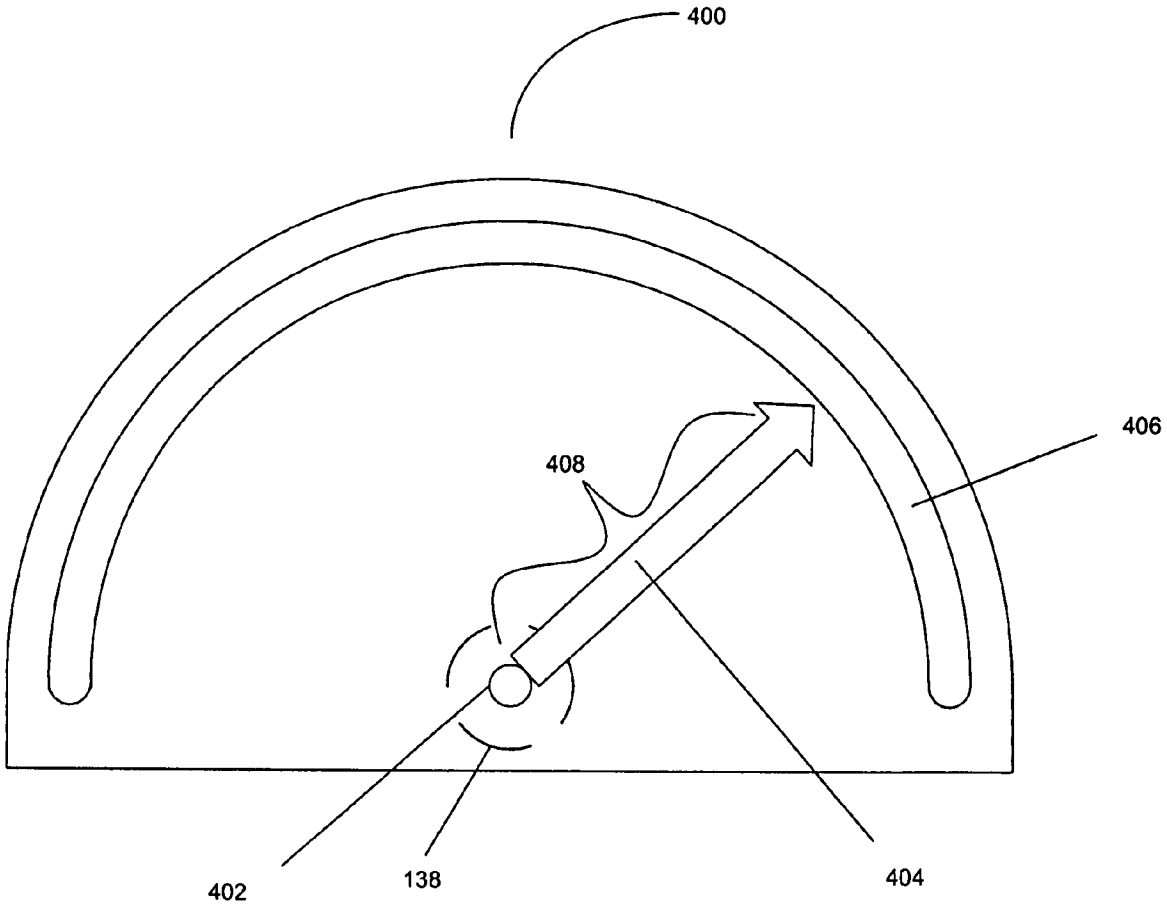
FIG. 4 illustrates an azimuth alignment mechanism of the present invention.

FIG. 4 illustrates an azimuth alignment mechanism of the present invention.

Mechanism 400 includes a pivot point 402, a pointer 404, and a locking keyway 406. Mast 138 is shown as being underneath mechanism 400, however, mechanism 400 can be surrounding mast 138 or otherwise attached to mast 138 without departing from the scope of the present invention.

Pivot 402 is typically a rivet, with a specified pre-load of tension/friction. As such, when mechanism 400 is mounted to mast 138, pivot 402 provides a consistent resistance to movement in a given direction around pivot 402. Pivot 402, when made as a rivet, holds the mechanism 400 together with a consistent force due to the weight of mechanism 400 on the front of mechanism 400, pressing mechanism 400 together while reducing or eliminating pointing errors when tightening or loosening azimuth lock nuts that are used in keyway 406. The rivet can be inserted with very tight tolerances which reduces or eliminates play between different parts of mechanism 400 about the pivot 402 axis. Since the pre-load of tension is not alterable by an installer, the azimuth setting indicated by arrow 404 will not be moved when mechanism 400 is locked down. Locking keyway 406 allows for a lock nut, similar to lock nut 136 shown in FIG. 3, to fix mechanism 400 in place after the desired azimuth setting for ODU 108 is determined.

Length 408 of pointer 404 is shown as larger than the diameter of mast 138. This allows for additional precision and better control of the azimuth movement of ODU 108 when mechanism 400 is used to align ODU 108. Further, the end of pointer 408 is sharp rather than blunt, which aids in the alignment process of ODU 108. This increased length 408, which is typically six inches, but can be of different values if desired, is also applicable to any elevation or tilt/skew mechanisms that are used to align ODU 108.

Fine Adjustment Mechanism

Figure 5:
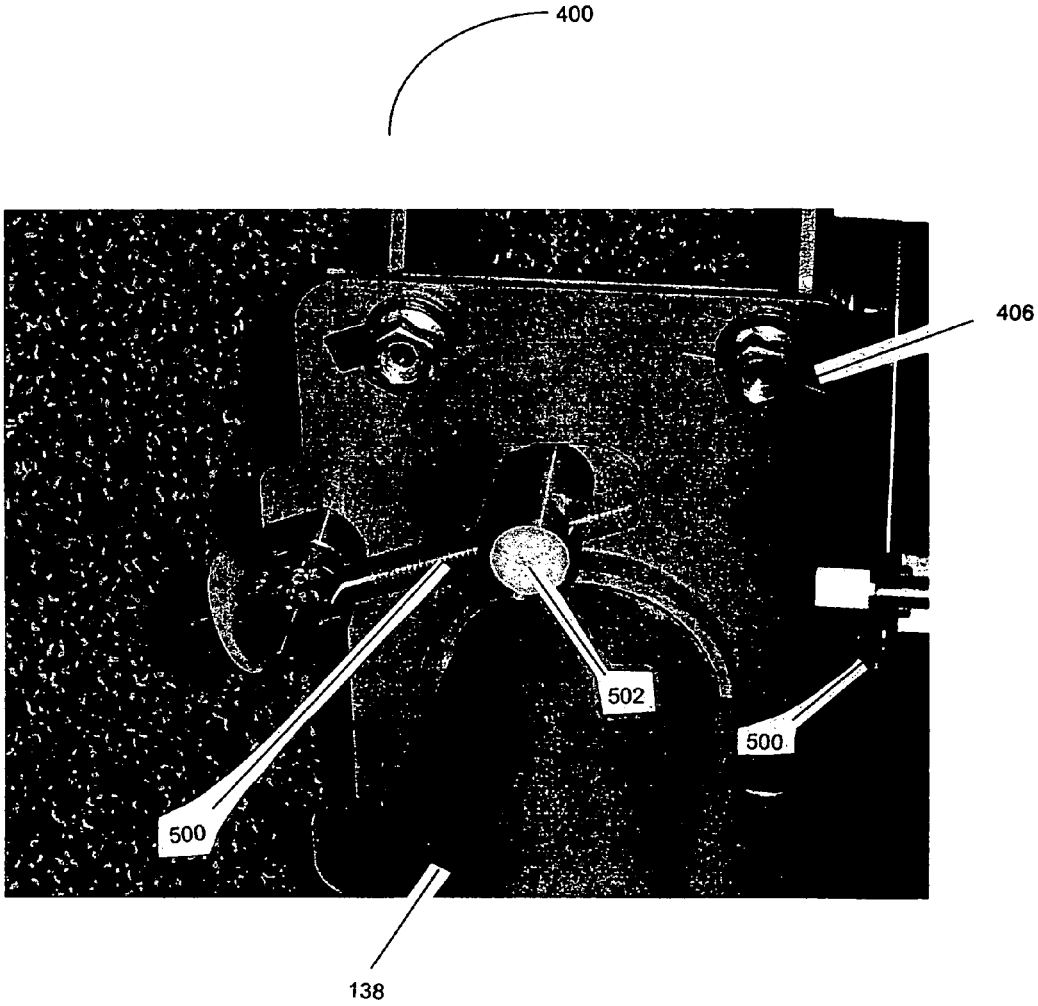
FIG. 5 illustrates a fine adjustment mechanism in accordance with the present invention.

FIG. 5 illustrates a fine adjustment mechanism in accordance with the present invention.

In related art alignment mechanisms, ODU 108 was aligned by use of hand movement of the ODU 108, e.g., physically grabbing or holding ODU 108, typically by grabbing or holding reflector 122, and twisting or tilting ODU 108. However, fine adjustments using such methods are difficult to perform.

Mechanism 400 includes adjustment screws 500 (azimuth adjustment screw 500 is shown in the center of FIG. 5, elevation adjustment screw 500 is shown on the tight of FIG. 5) and adjustment nut 502. For clarity, mast 138 and keyway 406 are also shown. Adjustment screw 500 is used to perform fine adjustment of ODU 108 by turning adjustment screw 500, mechanism 400 moves with respect to mast 138 (in azimuth). However, since adjustment screw 500 is metal, and adjustment nut 502 is plastic, where an interference fit is used between adjustment screw 500 and adjustment nut 502, mechanical backlash is reduced or eliminated, and, as such, there is no error when an installer turns adjustment screw a given number of turns. For example, and not by way of limitation, if an installer turns adjustment screw two turns, he knows that equals a specific number of degrees or parts of a degree, regardless of which way the adjustment screw 500 was turned previously, because the mechanical backlash of mechanism 400 is reduced by the use of plastic for adjustment nut 502.

By attaching adjustment nut 500 at a larger radius from the centerline of mast 138, the same pitch threads will yield additional precision for mechanism 400, in both azimuth and elevation adjustments. So, for example, a standard thread pitch of 20 threads per inch can be used rather than 32 threads per inch or 40 threads per inch, such that standard hardware and tool and die equipment can be used for adjustment bolt 500 and adjustment nut 502.

By using adjustment nut 500, mechanism 400 moves reflector 122 with respect to mast 138 (for azimuth adjustments) in very small, repeatable increments, so an installer can precisely align ODU 108 with a given point in the sky. Lock nuts can then be used in keyway 406 to fasten ODU 108 in the desired alignment position.

Thus, the use of a larger radius mechanism 400 (as indicated by length 408) and a fine adjustment mechanism (shown as adjustment screw 500 and adjustment nut 502), the ODU 108 can now be precisely aligned.

CONCLUSION

In summary, the present invention comprises an alignment mechanism for aligning an antenna to a satellite configuration and a system for delivering satellite signals using the alignment mechanism. An apparatus in accordance with the present invention comprises an antenna for receiving the satellite signals, a mast, for mounting the antenna to a desired location, and an alignment mechanism, coupled between the antenna and the mast, comprising an azimuth mechanism having a predetermined pre-load for adjusting the azimuth position of the antenna, and an elevation mechanism, coupled to the azimuth mechanism, for adjusting the elevation of the antenna, wherein the azimuth mechanism has a radius larger than a radius of the mast, and the azimuth mechanism further comprises a fine adjustment mechanism.

Such an alignment mechanism can also optionally include the fine adjustment mechanism comprising a nut having plastic threads, the predetermined pre-load being provided by a rivet at a pivot point of the azimuth mechanism a pointer, coupled to the alignment mechanism, wherein the pointer indicating an azimuth position of the antenna, the pointer having a sharp point for indicating position, the elevation mechanism further comprises a second fine adjustment mechanism, and the second fine adjustment mechanism comprising a nut having plastic threads.

It is intended that the scope of the invention be limited not by this detailed description, but rather by the claims appended hereto and the equivalents thereof. The above specification, examples and data provide a complete description of the manufacture and use of the composition of the invention. Since many embodiments of the invention can be made without departing from the spirit and scope of the invention, the invention resides in the claims hereinafter appended and the equivalents thereof.

What is claimed is:

1. An alignment mechanism for aligning an antenna to a satellite configuration, comprising:

an antenna for receiving the satellite signals;

a mast, for mounting the antenna to a desired location; and an alignment mechanism, coupled between the antenna and the mast, comprising:

an azimuth mechanism having a predetermined pre-load for adjusting the azimuth position of the antenna, the predetermined pre-load being provided by a rivet at a pivot point of the azimuth mechanism; and an elevation mechanism, coupled to the azimuth mechanism, for adjusting the elevation of the antenna, wherein the azimuth mechanism has a radius larger than a radius of the mast, and the azimuth mechanism further comprises a fine adjustment mechanism.

2. The alignment mechanism of claim 1, wherein the fine adjustment mechanism comprises a nut having plastic threads.

3. The alignment mechanism of claim 1, further comprising a pointer, coupled to the alignment mechanism, wherein the pointer indicates an azimuth position of the antenna.

4. The alignment mechanism of claim 3, wherein the pointer has a sharp point for indicating position.

5. The alignment mechanism of claim 3, wherein the elevation mechanism further comprises a second fine adjustment mechanism.

6. The alignment mechanism of claim 5, wherein the second fine adjustment mechanism comprises a nut having plastic threads.

7. A system for delivering satellite signals, comprising:

an uplink facility;

at least one satellite, receiving at least one uplink signal from the uplink facility; and transmitting at least one satellite signal;

a plurality of receivers, receiving the at least one satellite signal at an antenna, a mast, for mounting the antenna to a desired location; and an alignment mechanism, coupled between the antenna and the mast, comprising:

an azimuth mechanism having a predetermined pre-load for adjusting the azimuth position of the antenna, the pre-determined pre-load being provided by a rivet at a pivot point of the azimuth mechanism; and an elevation mechanism, coupled to the azimuth mechanism, for adjusting the elevation of the antenna, wherein the azimuth mechanism has a radius larger than a radius of the mast, and the azimuth mechanism further comprises a fine adjustment mechanism.

8. The system of claim 7, wherein the fine adjustment mechanism comprises a nut having plastic threads.

9. The system of claim 7, further comprising a pointer, coupled to the alignment mechanism, wherein the pointer indicates an azimuth position of the antenna.

10. The system of claim 9, wherein the pointer has a sharp point for indicating position.

11. The system of claim 9, wherein the elevation mechanism further comprises a second fine adjustment mechanism.

12. The system of claim 11, wherein the second fine adjustment mechanism comprises a nut having plastic threads.

13. An alignment mechanism for aligning an antenna to a satellite configuration, comprising:

a mast, for mounting the antenna; and an alignment mechanism, coupled between the antenna and the mast, comprising:

an azimuth mechanism having a predetermined pre-load for adjusting the azimuth position of the antenna, the pre-determined pre-load being provided by a rivet at a pivot point of the azimuth mechanism.

14. The alignment mechanism of claim 13, wherein the alignment mechanism further comprises an elevation mechanism, coupled to the azimuth mechanism, for adjusting the elevation of the antenna.

15. The alignment mechanism of claim 14, wherein the azimuth mechanism has a radius larger than a radius of the mast.

16. The alignment mechanism of claim 14, wherein the azimuth mechanism further comprises a fine adjustment mechanism.

* * * * *